US009259099B1

(12) United States Patent
Larsen et al.

(10) Patent No.: US 9,259,099 B1
(45) Date of Patent: Feb. 16, 2016

(54) FOAM MATTRESS WITH RESILIENT REINFORCING MEMBERS AND AIR CHANNELS

(71) Applicant: Sound Sleep Products, Inc., Sumner, WA (US)

(72) Inventors: John Robert Larsen, Sumner, WA (US); Peter Henry Horton, Sumner, WA (US); David E. Puterbaugh, Sumner, WA (US); Thomas R. Anderson, Sumner, WA (US)

(73) Assignee: Sound Sleep Products, Inc., Sumner, WA (US)

( * ) Notice: Subject to any disclaimer, the term of this patent is extended or adjusted under 35 U.S.C. 154(b) by 0 days.

(21) Appl. No.: 14/263,398

(22) Filed: Apr. 28, 2014

Related U.S. Application Data

(60) Provisional application No. 61/817,825, filed on Apr. 30, 2013.

(51) Int. Cl.

| | |
|---|---|
| ***A47C 27/14*** | (2006.01) |
| ***A47C 21/04*** | (2006.01) |
| ***A47C 27/16*** | (2006.01) |
| *A47C 27/15* | (2006.01) |

(52) U.S. Cl.
CPC ..... *A47C 27/148* (2013.01); *A47C 21/042* (2013.01); *A47C 27/142* (2013.01); *A47C 27/144* (2013.01); *A47C 27/16* (2013.01); *A47C 27/14* (2013.01); *A47C 27/15* (2013.01)

(58) Field of Classification Search
CPC ..... A47C 27/14–27/16; A47C 21/042
USPC ..... 5/721, 730, 727, 722, 740, 901
See application file for complete search history.

(56) References Cited

U.S. PATENT DOCUMENTS

| | | | |
|---|---|---|---|
| 1,446,290 | A | 2/1923 | Dessau |
| 4,407,031 | A | 10/1983 | Michiels |
| 4,628,557 | A | 12/1986 | Murphy |
| 4,916,765 | A | 4/1990 | Castronovo |
| 5,025,519 | A | 6/1991 | Spann et al. |
| 5,134,735 | A | 8/1992 | Rose |
| 5,533,218 | A | 7/1996 | Fahy |
| 5,641,068 | A | 6/1997 | Warner |

(Continued)

FOREIGN PATENT DOCUMENTS

| | | | |
|---|---|---|---|
| EP | 0018046 | A2 | 10/1980 |
| EP | 0782830 | A1 | 7/1997 |

(Continued)

*Primary Examiner* — Peter M Cuomo
*Assistant Examiner* — Brittany Wilson
(74) *Attorney, Agent, or Firm* — Mary M. Lee

(57) ABSTRACT

A mattress comprising a foam base, a foam core, and a foam comfort layer. The foam core may be reinforced with firmer transverse members selectively placed along the length of the core. The core may also include air passages. The comfort layer may comprise interlocking upper and lower layers configured to form ventilation channels that operate in a bellows-like fashion moving moist, warm out and drawing fresh air in as the sleeping body moves and shifts through the sleep cycle. The ventilation channels in the core and the comfort layer provide for effective dissipation of heat and moisture even from the innermost regions of the mattress. A cooling gel top layer may be included, and the entire assembly may be covered with a fabric top panel and surround. The surround may be vented to facilitate air movement in and out of the mattress.

16 Claims, 4 Drawing Sheets

(56) References Cited

U.S. PATENT DOCUMENTS

| | | | | |
|---|---|---|---|---|
| 5,765,246 | A | 6/1998 | Shoenhair | |
| 6,061,856 | A | 5/2000 | Hoffmann | |
| 6,223,371 | B1 | 5/2001 | Antinori et al. | |
| 6,574,814 | B2 | 6/2003 | Collard et al. | |
| 6,739,008 | B1 | 5/2004 | Kindrick | |
| 6,823,546 | B1 | 11/2004 | Hsu | |
| 7,013,512 | B1 | 3/2006 | Hsu | |
| 7,036,173 | B2 | 5/2006 | Gladney | |
| 7,222,379 | B2 | 5/2007 | DiGirolamo | |
| 7,293,311 | B2 * | 11/2007 | Baker | 5/721 |
| 7,334,280 | B1 | 2/2008 | Swartzburg | |
| 7,424,763 | B2 | 9/2008 | Gladney | |
| 7,426,767 | B2 | 9/2008 | Mossbeck | |
| 7,841,031 | B2 | 11/2010 | Rawls-Meehan | |
| 7,930,783 | B2 | 4/2011 | Rawls-Meehan | |
| 7,954,189 | B2 | 6/2011 | Rawls-Meehan | |
| 8,028,363 | B2 | 10/2011 | Rawls-Meehan | |
| 8,065,767 | B2 | 11/2011 | Gabbai et al. | |
| 8,075,981 | B2 | 12/2011 | Pearce et al. | |
| 8,181,296 | B2 | 5/2012 | Rawls-Meehan | |
| 8,209,804 | B2 | 7/2012 | Apperson et al. | |
| 8,250,689 | B2 | 8/2012 | Gladney | |
| 8,307,482 | B2 | 11/2012 | Gladney et al. | |
| 8,356,373 | B2 | 1/2013 | Allman et al. | |
| 2004/0074008 | A1 | 4/2004 | Martens et al. | |
| 2004/0098806 | A1 * | 5/2004 | Stender | A47C 7/021 5/654 |
| 2007/0094801 | A1 | 5/2007 | Kuo | |
| 2010/0237082 | A1 * | 9/2010 | Fernandez | A47C 7/021 5/655.5 |
| 2010/0264571 | A1 | 10/2010 | Tarazona De La Asuncion | |

FOREIGN PATENT DOCUMENTS

| | | | |
|---|---|---|---|
| ES | 2265206 | A1 | 2/2007 |
| JP | 2005304729 | A | 11/2005 |
| JP | 2006061641 | A | 3/2006 |

* cited by examiner

FOAM MATTRESS WITH RESILIENT REINFORCING MEMBERS AND AIR CHANNELS

CROSS-REFERENCE TO RELATED APPLICATIONS

This application claims the benefit of U.S. provisional application No. 61/817,825 entitled "Foam Mattress with Resilient Reinforcing Members and Air Channels," filed Apr. 30, 2013, the contents of which are incorporated herein by reference.

FIELD OF THE INVENTION

The present invention relates generally to bedding and more particularly, but without limitation, to foam mattresses.

BRIEF DESCRIPTION OF THE DRAWINGS

The accompanying drawings, which are incorporated into and form a part of the specification, illustrate one or more embodiments of the present invention and, together with this description, serve to explain the principles of the invention. The drawings merely illustrate a preferred embodiment of the invention and are not to be construed as limiting the scope of the invention.

DETAILED DESCRIPTION OF THE PREFERRED EMBODIMENT(S)

The ideal foam mattress addresses four important features: (1) pressure relief; (2) absorption and dissipation of heat; (3) dissipation of moisture; and, (4) good balanced support under the user's body weight and, in particular, providing additional support under the torso, the heaviest part of the body. The present invention provides a foam mattress that achieves all these goals.

Figure 1:
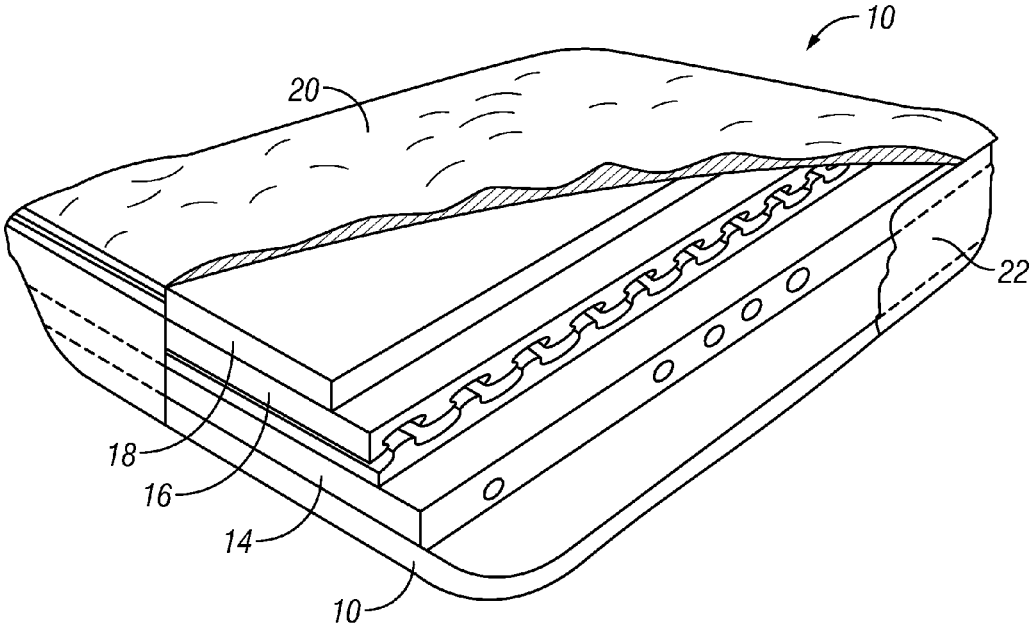
FIG. 1 is a partially cut-away perspective view of a mattress constructed in accordance with a preferred embodiment of the present invention.
Figure 2:
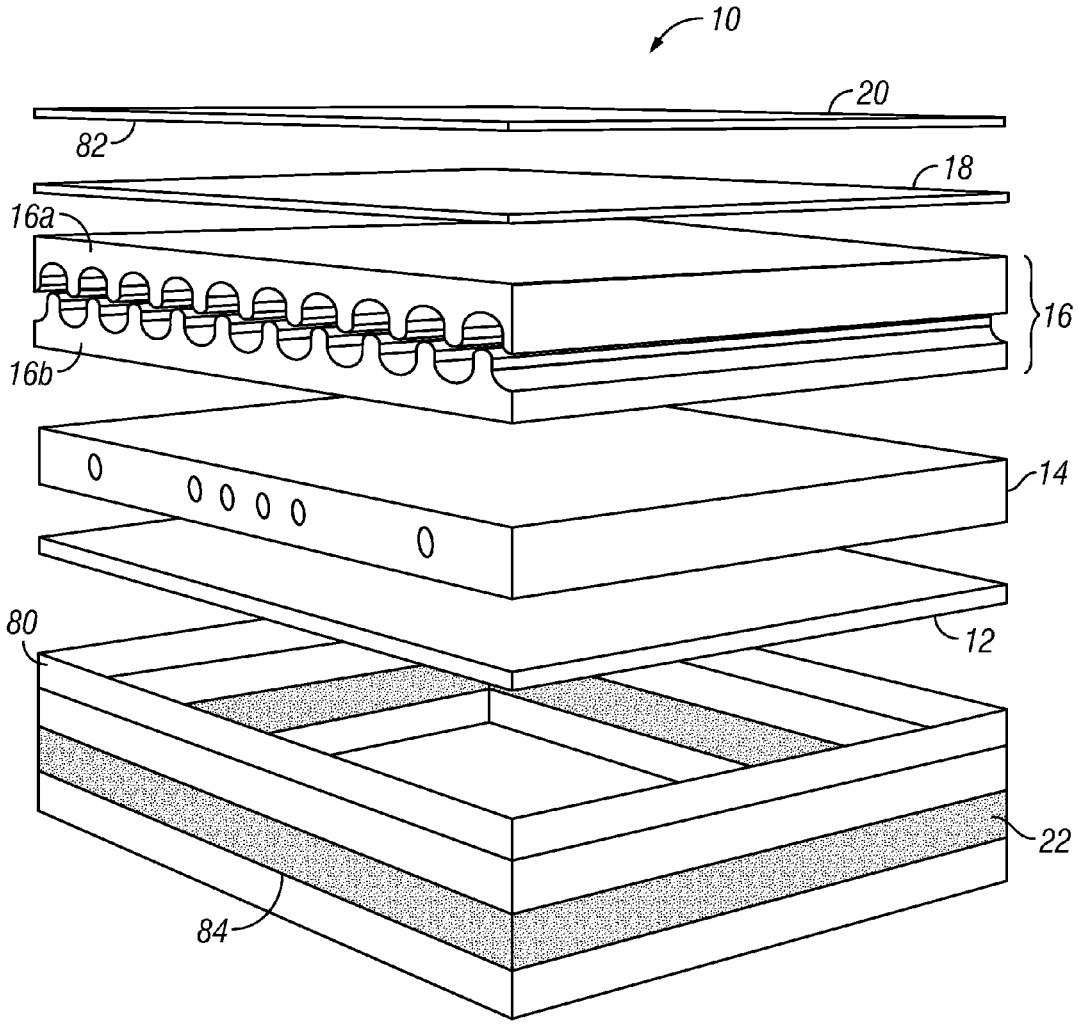
FIG. 2 is an exploded view of the mattress shown in FIG. 1.

Turning now to the drawings in general and to FIGS. 1 and 2 in particular, there is shown therein a foam mattress constructed in accordance with a preferred embodiment of the present invention and designated generally by the reference number 10. The mattress 10 generally comprises a base 12, a foam core 14, and a comfort layer 16 bonded to the foam core. In the preferred embodiment, a gel layer 18 is included on top of the comfort layer 16. The top of the mattress is covered by a fabric cover panel 20 and enclosed peripherally by a fabric surround 22.

The base 12 typically is made of a solid block of very firm polyurethane foam. Firmness in the foam mattress industry is commonly measured by indentation force deflection ("IFD") rating. By way of example, the base layer 12 may be a 1.5 inch layer of 1.65 pound, 70 IFD polyurethane foam. In a known manner, the base 12 is laminated to the bottom of the core 14.

Unless specifically identified as "memory foam" or "viscoelastic foam," as used herein the term "polyurethane foam" does not include memory foam.

Figure 3:
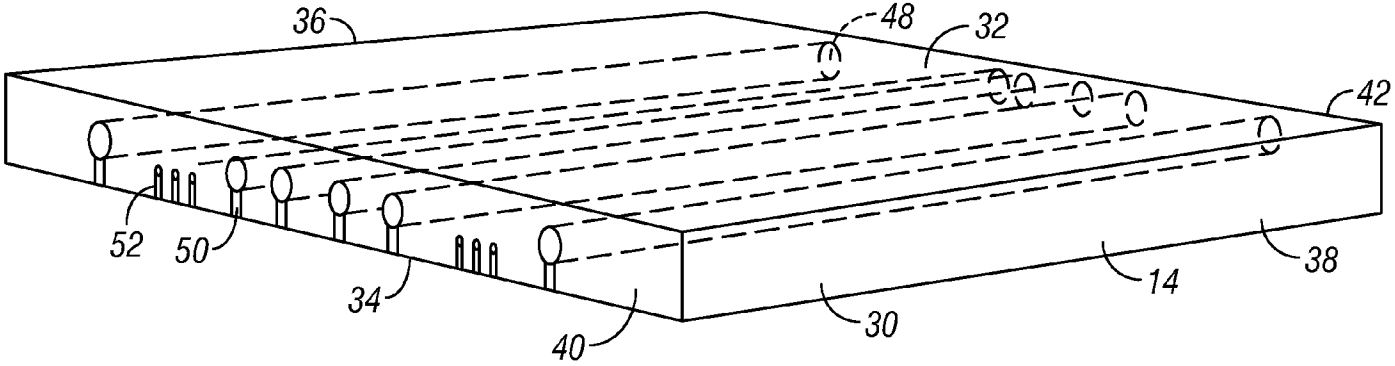
FIG. 3 is an enlarged perspective view of the core body with the reinforcing members removed.

A preferred construction for the core 14 will be described with reference to FIGS. 3 and 4. Generally, the core 14 is formed from a solid block or body 30 of foam or other resilient material. For example, the core body 30 may be about six (6) inches thick and formed of 1.8 pound, 24 IFD polyurethane foam. The body 30 has upper and lower surfaces 32 and 34, first and second ends 36 and 38, and first and second sides 40 and 42. The distance between the first and second sides 40 and 42 defines the width of the body 30. The distance between the first and second ends 36 and 38 defines the length "L" of the body 30. The distance between the upper and lower surfaces 32 and 34 defines the thickness or depth "D" of the body 30.

The length L of the body 30 defines a first end zone $Z_1$, a second end zone $Z_2$, and a central zone $Z_3$ extending between the first and second end zones. Depending on the orientation of the mattress on the bed frame (not shown), one of the first and second end zones $Z_1$ and $Z_2$ is the area at the head of the bed, and the other end zone is at the foot of the bed. The central zone $Z_3$ is the area under the user's torso and therefore carries the greatest weight.

In the preferred embodiment of the present invention, the core 14 is provided with one or more reinforcing members designated collectively at 46. The reinforcing members 46 are formed of foam having a firmness (IFD) of at least 1.5 times (150%) of the firmness of the core body. More preferably, the reinforcing members 46 are comprised of polyurethane foam having a firmness of between about one and one-half (1.5) times, or one hundred fifty percent (150%), to about four (4) times or four hundred percent (400%) the firmness (IFD) of the core body 30. Most preferably, the reinforcing members 46 are about three (3) times as firm as the core body 30. In a particularly preferred embodiment, the reinforcing members 46 are formed as solid cylinders of 1.65 pound, 70 IFD polyurethane foam.

As seen in the drawings, the reinforcing members 46 may take the form of elongate cylinders extending transversely across the entire width (first side 40 to second side 42) of the core body 30. That is, each of the reinforcing members 46 has a length corresponding to the width of the body 30. The number, size, shape, and position of the reinforcing members 46 may vary. In another preferred embodiment, the elongate reinforcing members are square in cross-section. Alternately, they may be polygonal, oval, or other shapes.

In the exemplary embodiment, a plurality of reinforcing members 46 is positioned generally across the center zone $Z_3$ of the core body 30 in order to support the heavier torso of the user's body. While several clustered members 46 are preferred, there may be cases where a single broader member is substituted therefor. However, in the preferred practice of this invention, four spaced apart member 46 in the center zone $Z_3$ provide good support. Additionally, one or more reinforcing members 46 may be provided at the first end zone $Z_1$ and at the second end zone $Z_2$.

Figure 4:
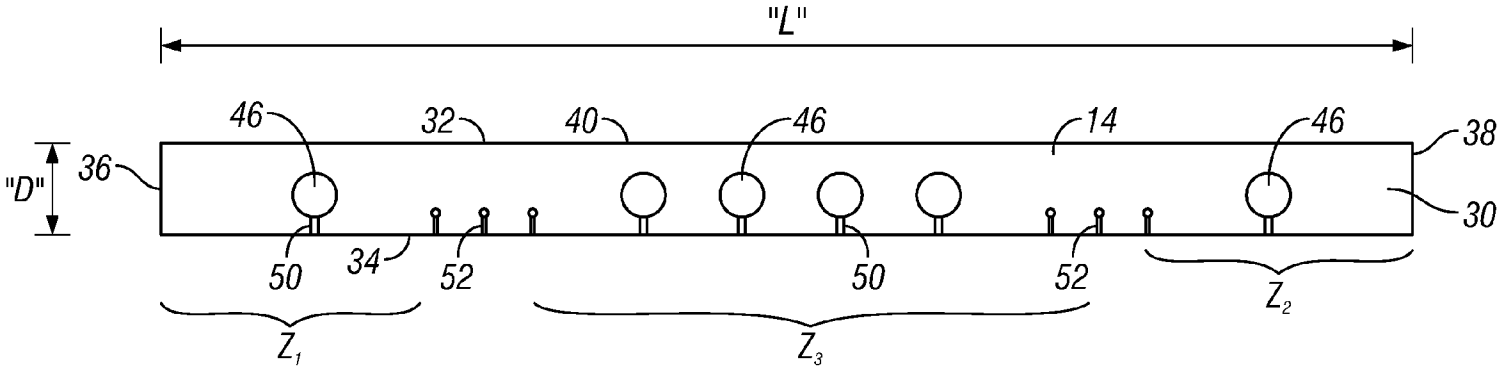
FIG. 4 is a side elevational view of the complete core.

As shown in FIG. 4, in the preferred embodiment, the reinforcing members 46 are positioned at about the middle of the vertical dimension or depth D of the body 30, although this may vary with the thickness of the body. The reinforcing members 46 should be positioned far enough below the upper surface 32 so as not to be perceptible to the user as individual structural elements, but close enough to the upper surface to provide support.

In the illustrated embodiment, the reinforcing members 46 extend to the very edge of the core body 30. This is desirable as many people like to sit on the edge of the bed, especially when shopping for a mattress. However, members that stop short of the edge by several inches may serve as well in some cases. As used herein, "substantially the width of the core" means that the resilient reinforcing members 46 extend close enough to the edge of the bed to provide support for a single occupant in a twin or full size mattress and to provide support for two occupants in a full size mattress or larger.

The method for positioning the reinforcing members 46 inside the core body 30 may vary. However, in the preferred construction, tubular bores designated generally at 48 for receiving the reinforcing members 46 may be formed in the core body 30 using a computer driven saw. In this way, for each reinforcing member 46, a keyhole shaped bore is formed. This provides a slot, designated generally at 50 extending from the bottom of each bore 48 to the lower surface 34 of the body 30. Then the reinforcing members 46 may be pressed into each bore 48 through the slots 50. In this way, the reinforcing members 46 are permanently fixed in the core body 30.

Now an additional benefit of the key-hole shaped cut-outs in the core body 30 will be understood. The slots 50, like the reinforcing members 46, run the entire width of the body 30, forming a ventilation channel beneath each reinforcing member. This allows air to pass through the center of the core body. Thus, moisture and heat accumulating in the core body 30 can escape the mattress through these slots 50, modulating the temperature of the body 30 and preventing the accumulation of moisture. Moreover, and also preferably by employing the same computer driven saw, additional ventilation channels 52 may be provided in the core body 30 at locations between the reinforcing members 46. Of course, the number, size, shape, and position of the ventilation channels 50 and 52 may vary.

With continuing reference to FIG. 2 and now also to FIGS. 5A, 5B, and 6, the comfort layer 16 will be explained. As seen in FIG. 2, the preferred comfort layer 16 is composed of two layers, a bottom layer 16*a* and a top layer 16*b*. These layers may both be memory foam, latex foam, or polyurethane foam. Still further, one layer, preferably the top layer 16*b* may be memory foam and the bottom layer 16*a* may be regular polyurethane foam.

The top layer 16*b* has a profiled lower surface 60, and the bottom layer 16*a* has a profiled upper surface 62. The profiled upper and lower surfaces 60 and 62 are configured for interlocking engagement. It will be appreciated that the particular shape of the profiled surfaces 60 and 62 may vary, so long as they are configured to fit together.

Figure 5A:
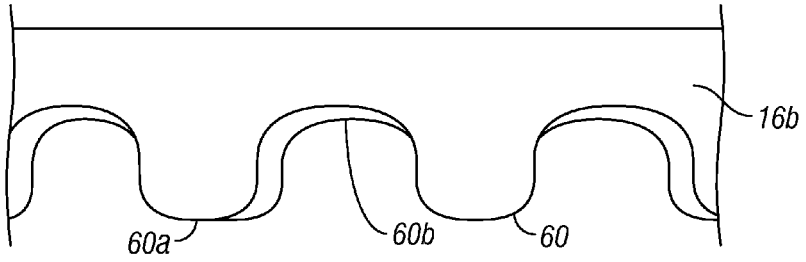
FIG. 5A is an enlarged, fragmented view of the upper comfort layer.
Figure 5B:
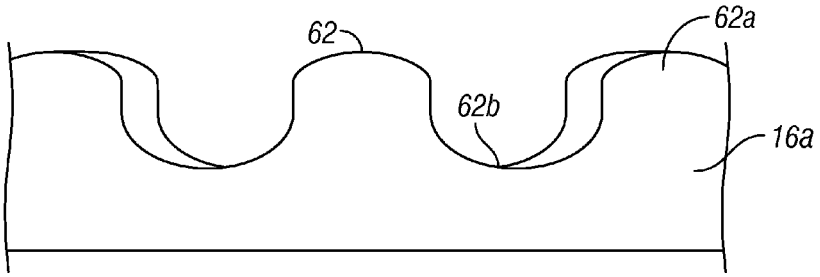
FIG. 5B is an enlarged, fragmented view of the lower comfort layer.
Figure 6:
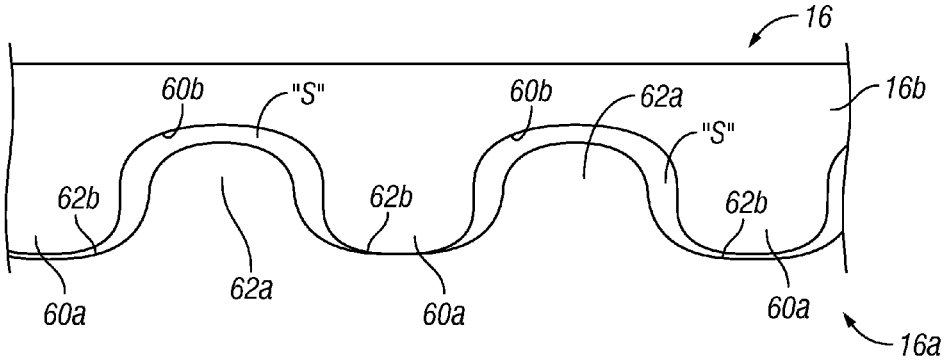
FIG. 6 is an enlarged section of the comfort layer illustrating the interlocking feature with ventilation channels.

For example, the profiled upper and under surface 60 and 62 may be formed into sinusoidal-like ridges 60*a* and 62*a* and grooves 60*b* and 62*b* (FIGS. 5A & 5B). In the most preferred embodiment, the ridges 62*a* on the lower surface 62 are shorter and or narrower than the corresponding grooves 60*b* in the upper surface 60. In this way, when the surfaces 60 and 62 are interlocked and at rest (without pressure), as seen in FIG. 6, the depending ridges 60*a* rest on the bottom of the grooves 62*b*, but a space "S" remains between the ridges 62*a* and the top of the grooves 60*b*. This arrangement could be reversed.

These spaces S function as ventilation channels. Because the ridges 60*a* and 62*a* and grooves 62*a* and 62*b* on the interlocking surfaces 60 and 62 run transversely through the comfort layer 16 from edge to edge, the ventilation channels provide continuous air flow in and out of the layer in a bellows-like manner across the entire width of comfort layer 16 as the body's weight shifts on the top of the mattress 10. More specifically, when pressure is applied to a particular area, the comfort layer 16 is compressed, squeezing air out of the channels; as pressure is released, the layers 60 and 62 resume their original resting shape, which draws air back into the channel as it expands. Thus, the ventilation channels S provide paths for both moisture and heat to escape the comfort layer 16 of the mattress 10 from the center to the periphery.

Referring again to FIGS. 1 and 2, the gel layer 18 preferably may comprise two layers of foam, such as memory foam, with a layer of medical grade gel in between. Preferably, the gel is pure medical grade gel. The medical grade gel assists with both pressure relief and heat dissipation. The cover panel 20 overlies the gel. The upper edge 80 of the fabric surround 22 is sewn to the peripheral edge 82 of the cover panel 20 to enclose the mattress 10. The preferred surround 22 includes a circumferential section 84 of open weave material. This facilitates the movement of air through the surround so that the air flow in and out of the core 14 and the comfort layer 16 is unimpeded.

Thus, the present invention provides a mattress 10 with several advantageous features. The foam core 14 is reinforced with firmer foam reinforcing members 46. This provides additional support where it is most needed—under the heavier torso of the body. Because so many like to sit on either the head or the foot, especially when selecting a mattress on a showroom flow, similar reinforcing members may be included at the head end or the foot end or both. Air tunnels or channels in the core 14 and in the comfort layer 16 provide air flow from deep within the center regions of the mattress 10 and across the width of the mattress.

The embodiments shown and described above are exemplary. Many details are often found in the art and, therefore, many such details are neither shown nor described herein. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. Likewise, the abstract is neither intended to define the invention, which is measured by the claims, nor is it intended to be limiting as to the scope of the invention in any way. Rather, the limits of the invention and the bounds of the patent protection are measured by and defined in the following claims.

What is claimed is:

1. A foam mattress comprising:

a foam base;

a foam core above the foam base; and a comfort layer above the foam core, wherein the comfort layer comprises a top layer with a profiled lower surface and a bottom layer with a profiled upper surface, the profiled upper and lower surfaces configured for interlocking engagement and to provide ventilation channels within the interlocking top and bottom layers, which ventilation channels extend continuously through the comfort layer to allow air movement therethrough and to dissipate heat and moisture from the center of the comfort layer to the periphery.

2. The foam mattress of claim 1 wherein the one of the profiled upper surface of the bottom layer and the profiled lower surface of the top layer comprises a plurality of ridges and wherein the other one of the profiled upper surface of the bottom layer and the profiled lower surface of the top layer comprises a plurality of the grooves, wherein the ridges are sized so that when received in the grooves, upper the interlocking ridges and grooves define the ventilation channels between the inner sidewalls of the grooves and the outer side walls of the ridges.

3. The foam mattress of claim 2 wherein one of the top and bottom layers of the comfort layer is formed of memory foam.

4. The foam mattress of claim 3 wherein the top layer of the comfort layer is formed of memory foam.

5. The foam mattress of claim 1 further comprising a gel layer on top of the comfort layer.

6. The foam mattress of claim 5 wherein the gel layer comprises a layer of medical grade gel between upper and lower layers of memory foam.

7. The foam mattress of claim 6 further comprising a fabric cover panel covering the top of the gel layer.

8. The foam mattress of claim 7 further comprising a fabric surround extending from the periphery of the fabric cover panel to the bottom of the base layer.

9. The foam mattress of claim 8 wherein the fabric surround comprises a circumferential section of open weave material to facilitate the passage of air therethrough.

10. The foam mattress of claim 1 further comprising a fabric surround extending around the periphery of assembled comfort, core, and base layers.

11. The foam mattress of claim 10 wherein the fabric surround comprises a circumferential section of open weave material to facilitate the passage of air therethrough.

12. The foam mattress of claim 1 wherein the foam core comprises:

a core body formed of resilient material and having upper and lower surfaces, first and second ends, and first and second sides, wherein the distance between the first and second sides defines the width of the body and the distance between the first and second ends defines the length of the body, wherein the length of the body defines a first end zone, a second end zone, and a central zone extending between the first and second end zones; and a plurality of elongate resilient reinforcing members, each having a length corresponding to the width of the body of the foam core and extending transversely completely through the body between the first and second sides and being permanently fixed therein, wherein the plurality of reinforcing members includes at least two members in the central zone, and at least one member in each of the head and foot zones, and wherein the firmness of the reinforcing members is at least about 1.5 times the firmness of the core body.

13. The foam mattress of claim 12 wherein each of the plurality of reinforcing members is cylindrical in shape.

14. The foam mattress of claim 12 wherein the at least two reinforcing members in the central zone comprises four spaced apart members in the central zone.

15. The foam mattress of claim 12 wherein the plurality of reinforcing members are formed of polyurethane foam having a firmness of between about 1.5 to about four times the firmness of the core body.

16. The foam mattress of claim 12 wherein the plurality of reinforcing members are formed of polyurethane foam having a firmness of about three times the firmness of the core body.

* * * * *

UNITED STATES PATENT AND TRADEMARK OFFICE

CERTIFICATE OF CORRECTION

PATENT NO. : 9,259,099 B1
APPLICATION NO. : 14/263398
DATED : February 16, 2016
INVENTOR(S) : John Robert Larsen et al.

It is certified that error appears in the above-identified patent and that said Letters Patent is hereby corrected as shown below:

In the Specification:

Column 2, line 54: replace “member” with --members--.
Column 3, line 60: replace “grooves 62a” with --grooves 60b--.

In the Claims:

Column 5, line 2: replace “upper the” with --the--.

Signed and Sealed this
Third Day of May, 2016

Michelle K. Lee

Michelle K. Lee
*Director of the United States Patent and Trademark Office*